US006558121B2

(12) United States Patent
Zhu et al.

(10) Patent No.: US 6,558,121 B2
(45) Date of Patent: May 6, 2003

(54) METHOD AND APPARATUS FOR TURBINE BLADE CONTOURED PLATFORM

(75) Inventors: Gaoqiu Zhu, Peabody, MA (US); Mark Douglas Gledhill, Hamilton, MA (US); Douglas Bryan Ballantyne, Ipswich, MA (US)

(73) Assignee: General Electric Company, Schenectady, NJ (US)

( * ) Notice: Subject to any disclaimer, the term of this patent is extended or adjusted under 35 U.S.C. 154(b) by 0 days.

(21) Appl. No.: 09/942,299

(22) Filed: Aug. 29, 2001

(65) Prior Publication Data

US 2003/0044282 A1 Mar. 6, 2003

(51) Int. Cl.[7] ..... F01D 5/14
(52) U.S. Cl. ..... 416/193 A; 29/889.7
(58) Field of Search ..... 416/193 A, 239, 416/223 A, 219 R, 220 R; 29/889.7

(56) References Cited

U.S. PATENT DOCUMENTS 5,486,095 A * 1/1996 Rhoda et al. ..... 416/214 A
5,971,710 A * 10/1999 Stauffer et al. ..... 415/118

* cited by examiner

*Primary Examiner*—Edward K. Look
*Assistant Examiner*—Kimya N McCoy
(74) *Attorney, Agent, or Firm*—Rodney M. Young; Armstrong Teasdale LLP; Robert B. Reeser, III

(57) ABSTRACT

A turbine blade assembly for a gas turbine engine that includes a turbine platform including contoured edges. The turbine blade assembly includes a platform, a turbine airfoil extending radially outward from the platform, a shank that extends radially inward from the platform, and a dovetail extending from the shank. The platform includes a leading edge and a trailing edge separated by a pressure edge and an opposite suction edge, the pressure edge including a plurality of arcs extending between the leading edge and the trailing edge, the suction edge including a plurality of arcs extending between the leading and trailing edges.

20 Claims, 4 Drawing Sheets

METHOD AND APPARATUS FOR TURBINE BLADE CONTOURED PLATFORM

STATEMENT REGARDING FEDERALLY SPONSORED RESEARCH & DEVELOPMENT

The United States Government has rights in this invention pursuant to Contract Nos. DAAH 10-98-C-0023 and F33615-98-C-2803.

BACKGROUND OF THE INVENTION

This invention relates generally to gas turbine engines and, more particularly, to gas turbine engine blade assemblies.

A gas turbine engine typically includes a plurality of turbine blade assemblies. Each assembly includes a turbine airfoil that extends radially outwardly from a platform, a shank that extends radially inward from the platform, and a dovetail that extends from the shank. The turbine airfoil includes a pressure side and a suction side, which are connected at a turbine airfoil trailing edge. An airfoil root is formed between each turbine airfoil and platform. At least some known turbine blade assemblies include a high-c portion, defined generally as where the airfoil root is tangent to an engine centerline axis. Each turbine blade assembly is circumferentially joined to a rotor disk by the dovetail. Each platform extends circumferentially and axially beyond the airfoil root and defines a leading edge and a trailing edge that are separated by a pressure edge and a suction edge. At least some known platforms have straight pressure and suction edges that extend with a skew angle that is oblique with regard to leading and trailing edges such that an interior angle defined between the leading edge and the suction edge is not equal to 90 degrees. An outer surface of each platform typically defines a radially inner flowpath surface for gas flowing through the turbine blade assembly.

During engine operation, centrifugal forces generated by the rotating airfoils are carried by the airfoils, platforms, shanks and dovetails. The centrifugal forces generate stress in the shanks and dovetails below the platforms. To facilitate reducing stress concentrations, at least some known gas turbines vary, for example, a number of turbine blade assemblies, a platform skew angle, a dovetail skew angle, a dovetail length, a turbine airfoil shape, a dovetail fillet size, a shank transition under the platform, a shank size, a distribution of material in the dovetail, and geometry of seals between turbine blade assemblies. However, increasing the platform skew angle or size of the platform may cause high stresses to be induced in the shank and dovetail under the platform. In addition, because the platform is exposed directly to the flowpath gasses, thermal gradients may also be generated.

BRIEF DESCRIPTION OF THE INVENTION

In one aspect, a method of fabricating a turbine blade assembly is provided. The turbine blade assembly includes a platform, a turbine airfoil extending radially outward from the platform, a shank extending radially inward from the platform, and a dovetail extending from the shank. The platform includes a leading edge, a trailing edge, a pressure edge, and a suction edge. The method includes forming the platform pressure edge into a plurality of arcs to facilitate reducing stress concentrations and forming the platform suction edge into a plurality of arcs complementary to the pressure edge.

In another aspect, a turbine blade assembly is provided for a gas turbine engine. The turbine blade assembly includes a platform, a turbine airfoil extending radially outward from the platform, a shank extending radially inward from the platform, and a dovetail extending from the shank. The platform includes a leading edge and a trailing edge separated by a pressure edge and an opposite suction edge, the pressure edge includes a plurality of arcs extending between the leading edge and the trailing edge, the suction edge includes a plurality of arcs extending between the leading and trailing edges.

In a further aspect, a gas turbine engine including at least one turbine blade assembly that includes a platform, a turbine airfoil extending radially outward from the platform, a shank extending radially inward from the platform, and a dovetail extending from the shank. The platform includes a leading edge and a trailing edge separated by a pressure edge and an opposite suction edge. The pressure edge includes a plurality of arcs extending between the leading edge and the trailing edge, the suction edge includes a plurality of arcs extending between the leading and trailing edges.

DETAILED DESCRIPTION OF THE INVENTION

Figure 1:
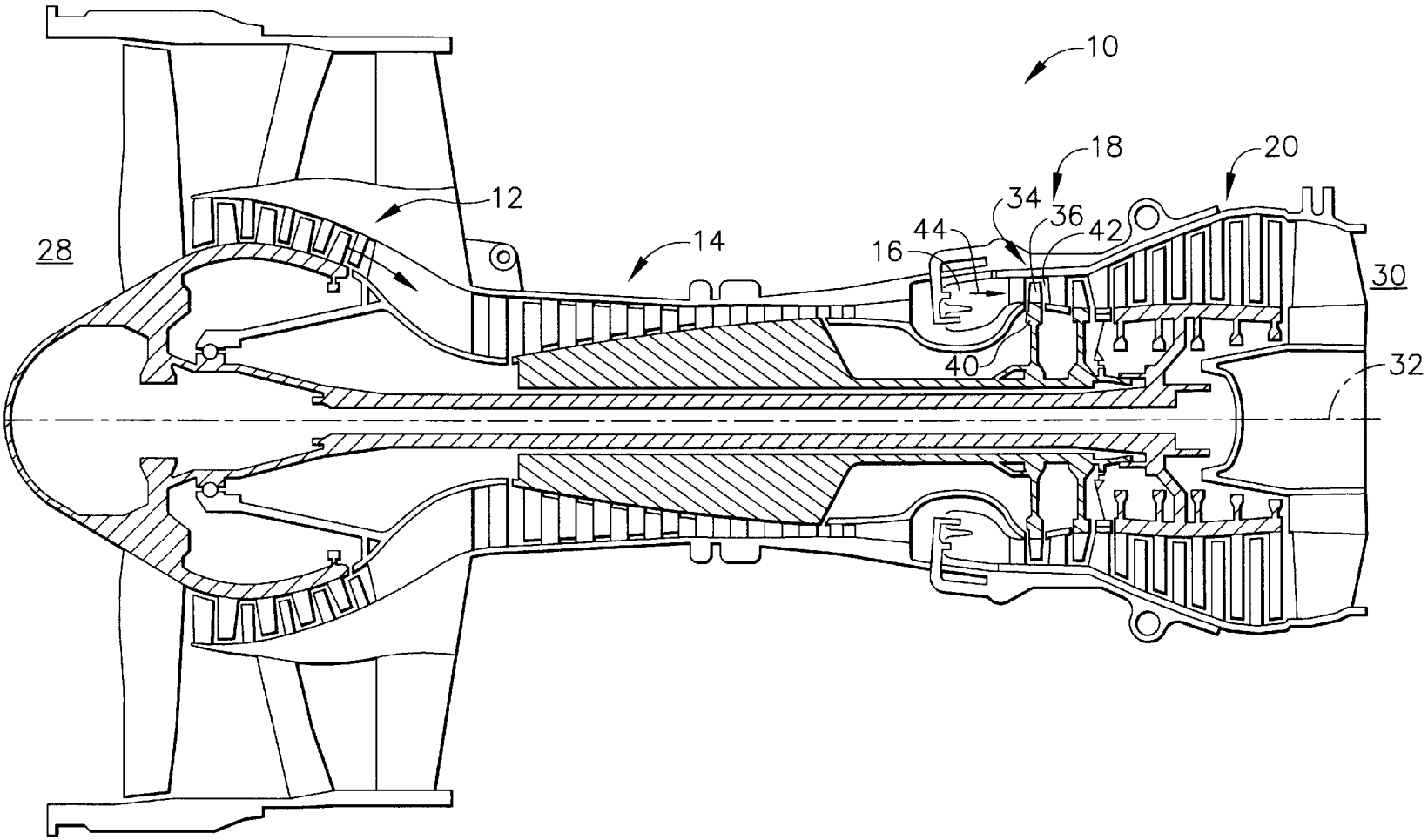
FIG. 1 is schematic illustration of a gas turbine engine.

FIG. 1 is a schematic illustration of a gas turbine engine 10 including a fan assembly 12, a compressor 14, a combustor 16, a high-pressure turbine 18, and a low-pressure turbine 20. Engine 10 has an intake side 28, an exhaust side 30, and a centerline axis 32. In an exemplary embodiment, gas turbine engine 10 includes a plurality of turbine blade assemblies 34. Each turbine blade assembly 34 includes at least one turbine airfoil 36 extending radially outward from a supporting rotor disk 40. Turbine blade assemblies 34 are spaced circumferentially around rotor disk 40 and define therebetween a flowpath 42 through which gas 44 is channeled during operation.

In operation, air flows through fan assembly 12 and compressed air is supplied to compressor 14. The compressed air is delivered to combustor 16. Gas 44 from combustor 16 drives turbines 18 and 20, and turbine 20 drives fan assembly 12. Turbine 18 drives compressor 14.

Figure 2:
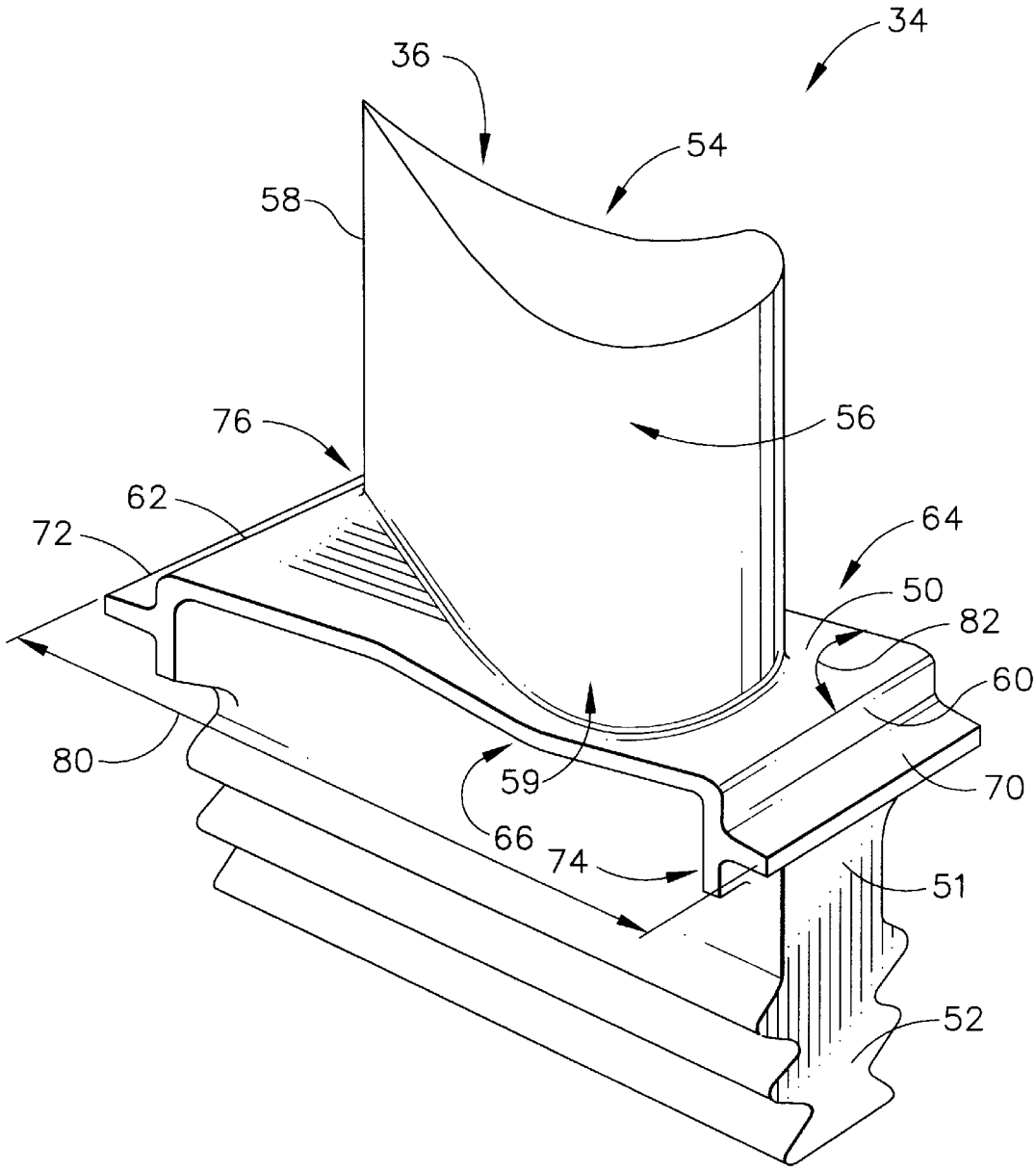
FIG. 2 is a perspective view of a turbine blade assembly that may be used with the gas turbine engine shown in FIG. 1.

FIG. 2 is a perspective view of turbine blade assembly 34 that may be used with the gas turbine engine 10 (shown in FIG. 1). Turbine blade assembly 34 includes a platform 50, turbine airfoil 36 extending radially outward from platform 50, a shank 51 extending radially inward from platform 50, and a dovetail 52 extending from shank 51. Turbine airfoil 36 includes a pressure side 54 and a suction side 56, which are connected at a turbine airfoil trailing edge 58. Turbine airfoil suction side 56 includes a high-c portion 59.

Platform 50 includes a leading edge 60 and a trailing edge 62 which are connected with a pressure edge 64 and an opposite suction edge 66. Platform 50 also includes a forward angel wing 70, an aft angel wing 72, a leading edge overhang 74, and a trailing edge overhang 76. Overhangs 74 and 76 extend circumferentially beyond dovetail 52. Leading edge 60 and trailing edge 62 are substantially parallel and define an axial platform length 80 measured perpendicularly between platform leading and trailing edges 60 and 62. Pressure edge 64 and suction edge 66 extend between leading and trailing edges 60 and 62.

Pressure edge 64 and leading edge 60 define a first interior skew angle 82. Pressure edge 64 and trailing edge 62 define a second interior skew angle (not shown in FIG. 2). Pressure edge 64 of platform 50 generally abuts suction edge 66 of a circumferentially adjacent turbine blade assembly 34 (not shown). Adjacent platforms 50 define a radially inner flowpath surface for gas 44.

Figure 3:
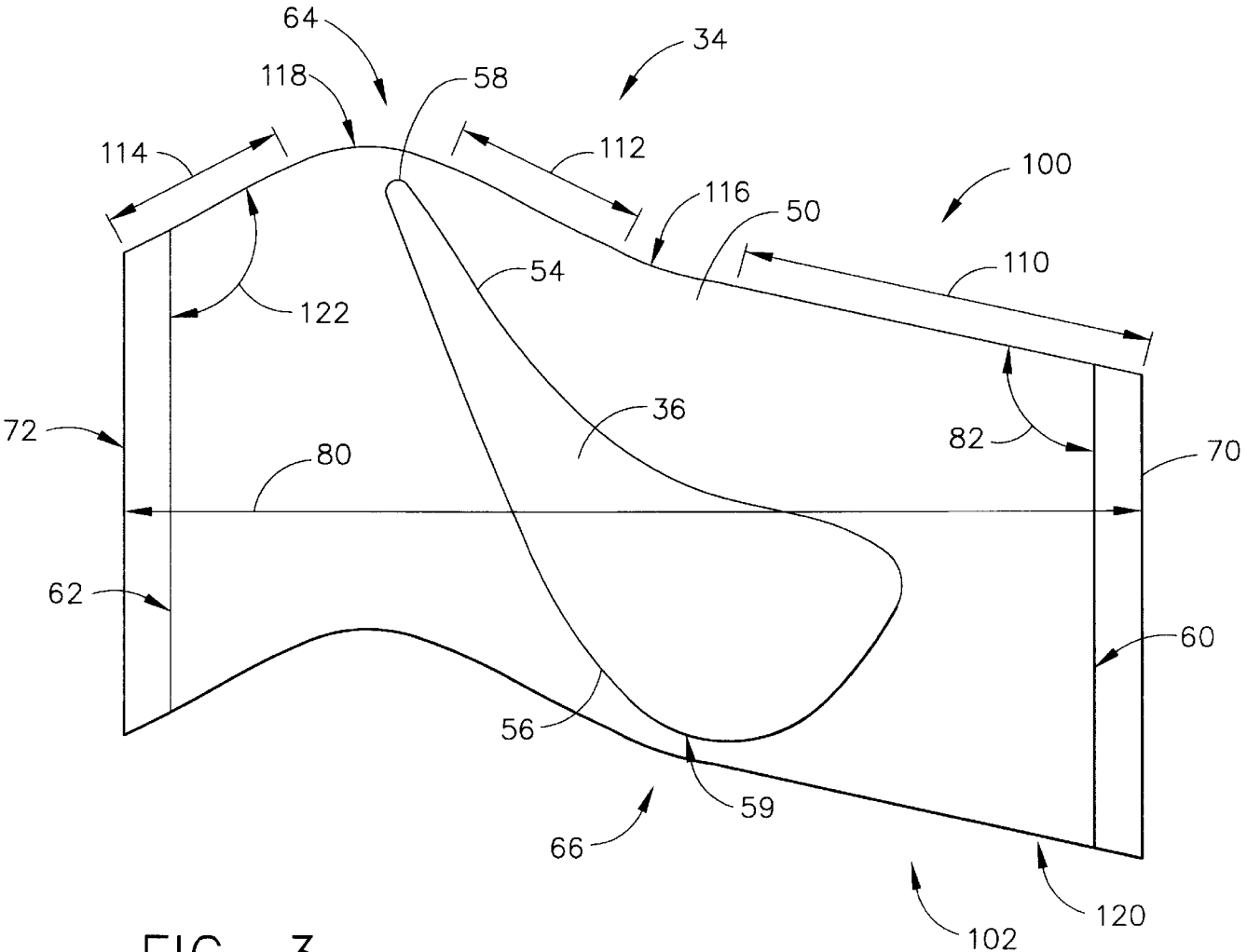
FIG. 3 is a top view of the turbine blade assembly shown in FIG. 2.

FIG. 3 is a top view of turbine blade assembly 34 shown in FIG. 2. Pressure edge 64 includes a plurality of arcs 100 that extend between platform leading and trailing edges 60 and 62. Suction edge 66 also includes a plurality of arcs 102. In one embodiment, arcs 102 are substantially complementary to the pressure edge arcs 100. More specifically, suction edge arcs 102 are configured to mate to pressure edge arcs 100 to facilitate sealing circumferentially adjacent turbine blade assemblies (not shown). Suction edge arcs 102 abut adjacent turbine blade assembly pressure edge arcs (not shown). Pressure edge arcs 100 contour from first skew angle 82 to turbine airfoil trailing edge 58 such that turbine airfoil 36 is fully supported by platform 50. Contoured pressure edge arcs 100 and suction edge arcs 102 facilitate shaping platform 50 to balance stresses over dovetail 52 (shown in FIG. 2).

In the exemplary embodiment, pressure edge arcs 100 include three non-parallel, substantially linear portions 110, 112, and 114. Substantially linear portions 110 and 112 are separated by a concave arc segment 116. A convex arc segment 118 separates substantially linear portions 112 and 114. More specifically, substantially linear portion 110 extends from leading edge 60 at first skew angle 82 to join concave arc segment 116. Concave arc segment 116 extends to substantially linear portion 112. Substantially linear portion 112 joins to convex arc segment 118, extending platform 50 to support turbine airfoil trailing edge 58. Convex arc segment 118 joins to substantially linear portion 114 which extends to trailing edge 62. Convex arc segment 118 is adjacent turbine airfoil trailing edge 58. Suction edge arcs 102 are complementary to pressure edge arcs 100 such that an adjacent turbine blade assembly pressure edge (not shown) mates with suction edge 66. Suction edge arcs 102 include a suction edge first substantially linear portion 120 extending from leading edge 60 to adjacent turbine airfoil high-c portion 59.

Substantially linear portion 114 and trailing edge 62 define a second interior skew angle 122. In the exemplary embodiment, second interior skew angle 122 is not complementary to first interior skew angle 82. In an exemplary embodiment, first interior skew angle 82 subtends between 97 and 107 degrees or about 102 degrees, while second interior skew angle 122 subtends between 112 and 122 degrees or about 117 degrees. In an exemplary embodiment, platform length 80 is 100 cm, substantially linear portion 110 extends 45 cm, substantially linear portion 112 extends 20 cm, and substantially linear portion 114 extends 18 cm. Pressure edge 64 and suction edge 66 shape platform 50 and balance stresses over dovetail 52. In another embodiment, pressure edge arcs 100 include a concave arc segment and an adjoining convex arc segment (not shown) which together extend from leading edge 60 to trailing edge 62.

Figure 4:
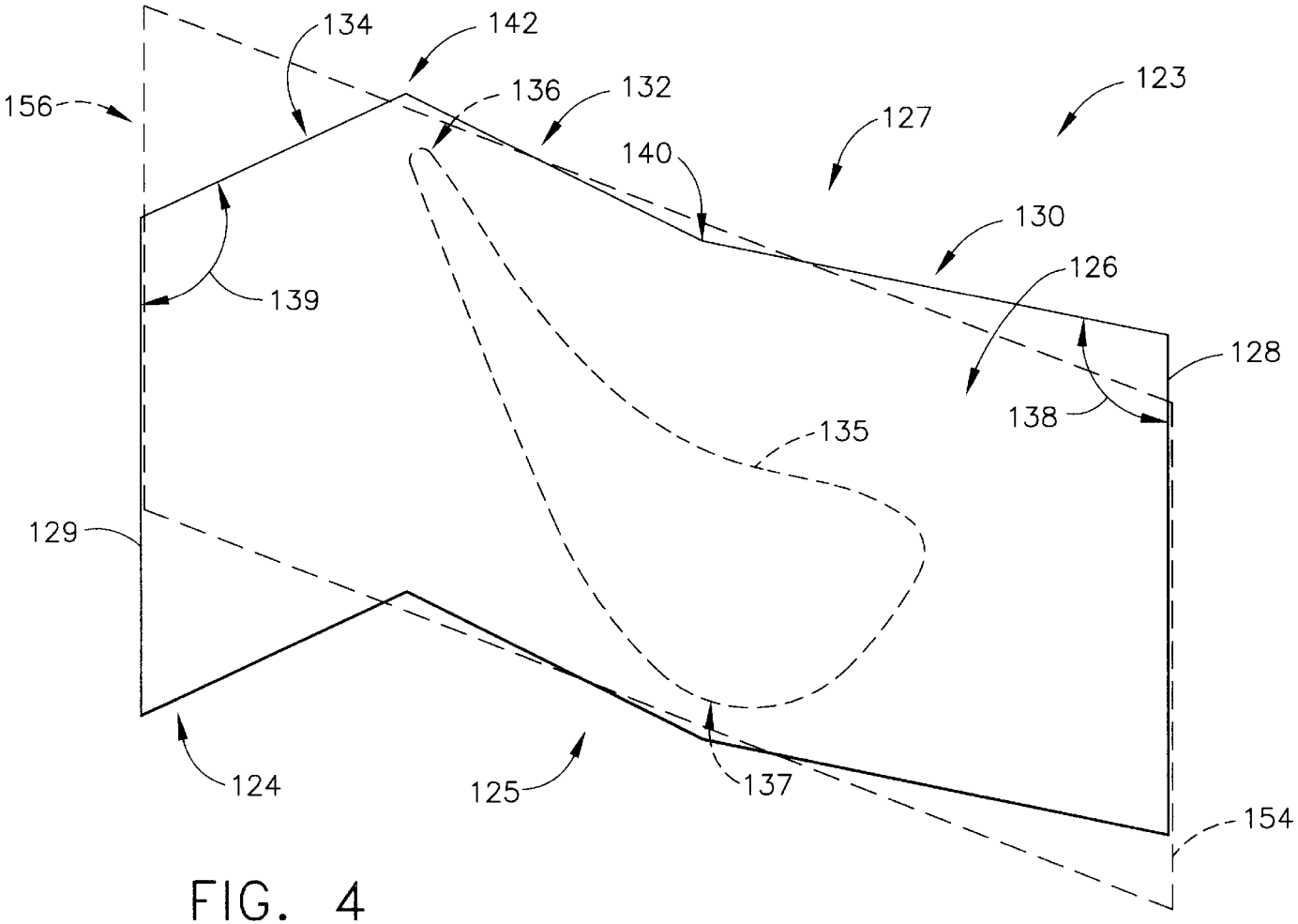
FIG. 4 is a top view of an alternative embodiment of a turbine blade assembly and a known skewed platform shown in phantom.

FIG. 4 is a top view of an alternative embodiment of a turbine blade assembly 123 and a known skewed platform 124 shown in phantom. In one embodiment, turbine blade assembly 123 includes a platform 126, a suction edge arc 125, a pressure edge arc 127, a leading edge 128, a trailing edge 129, and a plurality of substantially linear portions 130, 132, and 134. Turbine blade assembly 123 also includes an airfoil 135, which includes a trailing edge 136, and a high-c portion 137. Specifically, in the exemplary embodiment, blade assembly 123 includes three non-parallel linear portions 130, 132, and 134 that are arranged such that portion 132 extends entirely between portions 130 and 134. More specifically, substantially linear portion 130 extends from leading edge 128 at a first skew angle 138. Substantially linear portion 130 abuts non-parallel substantially linear portion 132 at a pressure edge first junction 140. Substantially linear portion 134 extends from trailing edge 129 at a second skew angle 139 and intersects non-parallel substantially linear portion 132 at a pressure edge second junction 142. Suction edge arc 125 is complementary to the pressure edge arc 127. More specifically, pressure edge second junction 142 is in close proximity of a airfoil trailing edge 136. First junction 140 is in close proximity to the high-c portion of the adjacent turbine blade assembly (not shown).

Turbine blade assembly platform 126 is shifted as compared to a known skewed platform 124. Contouring platform pressure edge arc 127 supports turbine airfoil 135 while balancing stresses. More specifically, contouring platform pressure and suction edge arcs 127 and 125 effectively shifts a leading edge overhang 154 and a trailing edge overhang 156 to facilitate stress reduction.

During operation, as turbine blade assembly 34 rotate, centrifugal loads generated by rotating airfoils 36 are carried by platforms 50, shanks 51, and dovetails 52 below turbine airfoils 36. Platform 50, shanks 51, and dovetails 52 are subject to centrifugal load stresses that vary with engine power demands. Inability to carry the stress could impact a low cycle fatigue life (LCF) of turbine blade assemblies 34. Pressure edge arcs 100 and suction edge arcs 102 contour platform 50 to redistribute load and further facilitate reducing peak stress by reducing leading edge and trailing edge overhang. Platform 50 balance over dovetail 52 facilitates extending the LCF life of platforms 50, shanks 51, and dovetails 52.

The above-described turbine blade assemblies are cost-effective and highly reliable. The turbine assembly includes a turbine airfoil that extends radially outward from a platform and includes contoured pressure and suction edges that facilitate reducing stress concentrations induced to the turbine blade assemblies. During operation, the contoured pressure and suction edges provide stress reduction by balancing the platform over the dovetail. As a result, lower peak stresses are generated under the platform, including the leading and trailing edges. Thus, a turbine assembly is provided which operates at a high efficiency and reduced stress.

While the invention has been described in terms of various specific embodiments, those skilled in the art will recognize that the invention can be practiced with modification within the spirit and scope of the claims.

What is claimed is:

1. A method of fabricating a turbine blade assembly for a gas turbine engine, the turbine blade assembly including a platform, a turbine airfoil extending radially outward from the platform, a shank extending radially inward from the platform, and a dovetail extending from the shank, the platform including a leading edge, a trailing edge, a pressure edge, and a suction edge, said method comprising:

forming the platform pressure edge into a plurality of arcs to facilitate reducing stress concentrations, wherein at least two axially-spaced arcs are substantially co-planar along the platform pressure edge; and forming the platform suction edge into a plurality of arcs complementary to the pressure edge.

2. A method in accordance with claim 1 wherein forming the platform pressure edge further comprises forming the platform pressure edge into at least two substantially linear segments separated by at least one arc.

3. A method in accordance with claim 1 wherein forming the platform pressure edge further comprises forming the platform pressure edge into at least one concave arc and at least one convex arc.

4. A method in accordance with claim 1 wherein forming the platform pressure edge further comprises:

forming the platform pressure edge into at least two substantially linear portions separated by at least one convex arc; and forming the platform suction edge into at least two substantially linear portions separated by at least one concave arc.

5. A turbine blade assembly for a gas turbine engine, said turbine blade assembly comprising:

a platform;

a turbine airfoil extending radially outward from said platform;

a shank extending radially inward from said platform; and a dovetail extending from said shank, said platform comprising a leading edge and a trailing edge separated by a pressure edge and an opposite suction edge, said pressure edge comprising a plurality of arcs extending between said leading edge and said trailing edge, at least two axially-spaced arcs are substantially co-planar along said pressure edge, said suction edge comprising a plurality of arcs extending between said leading and trailing edges.

6. A turbine blade assembly in accordance with claim 5 wherein said pressure edge arcs and said suction edge arcs configured to reduce stresses induced to said turbine blade assembly.

7. A turbine blade assembly in accordance with claim 5 wherein said pressure edge further comprises at least two substantially linear portions.

8. A turbine blade assembly in accordance with claim 5 wherein said pressure edge arcs comprises at least one concave arc and at least one convex arc.

9. A turbine blade assembly in accordance with claim 5 wherein said pressure edge further comprises at least three substantially linear portions separated by at least one concave arc and by at least one convex arc.

10. A turbine blade assembly in accordance with claim 5 wherein said turbine airfoil comprises a pressure side, a suction side, and a high-c portion, said platform suction edge further comprises a first substantially linear portion extending from said leading edge to adjacent said turbine airfoil high-c portion.

11. A turbine blade assembly in accordance with claim 5 wherein said turbine airfoil comprises a pressure side, a suction side, and a turbine airfoil trailing edge, said platform pressure edge further comprises at least one substantially linear portion extending from said trailing edge to adjacent said turbine airfoil trailing edge.

12. A turbine blade assembly in accordance with claim 5 wherein at least one of said pressure edge and said suction edge further comprises a first portion angularly displaced from said leading edge by about 102 degrees, and a second portion angularly displaced from said trailing edge by about 117 degrees.

13. A gas turbine engine comprising at least one turbine blade assembly comprising:

a platform;

a turbine airfoil extending radially outward from said platform;

a shank extending radially inward from said platform; and a dovetail extending from said shank, said platform comprising a leading edge and a trailing edge separated by a pressure edge and an opposite suction edge, said pressure edge comprising a plurality of arcs extending between said leading edge and said trailing edge, at least two axially-spaced arcs are substantially co-planar along said pressure edge, said suction edge comprising a plurality of arcs extending between said leading and trailing edges.

14. A gas turbine engine in accordance with claim 13 wherein said pressure edge arcs and said suction edge arcs configured to reduce stresses induced to said turbine blade assembly.

15. A gas turbine engine in accordance with claim 13 wherein said pressure edge further comprises at least two substantially linear portions.

16. A gas turbine engine in accordance with claim 13 wherein said pressure edge arcs comprise at least one concave arc and at least one convex arc.

17. A gas turbine engine in accordance with claim 13 wherein said pressure edge further comprises at least three substantially linear portions separated by at least one concave arc and by at least one convex arc.

18. A gas turbine engine in accordance with claim 13 wherein said turbine airfoil comprises a pressure side, a suction side, and a high-c portion, said platform suction edge further comprises a first substantially linear portion extending from said leading edge to adjacent said turbine airfoil high-c portion.

19. A gas turbine engine in accordance with claim 13 wherein said turbine airfoil comprises a pressure side, a suction side, and a turbine airfoil trailing edge, said platform pressure edge further comprises at least one substantially linear portion extending from said trailing edge to adjacent said turbine airfoil trailing edge.

20. A gas turbine engine in accordance with claim 13 wherein at least one of said pressure edge and said suction edge further comprises a first portion angularly displaced from said leading edge by about 102 degrees, and a second portion angularly displaced from said trailing edge by about 117 degrees.

* * * * *